US006329767B1

(12) United States Patent
Sievers

(10) Patent No.: US 6,329,767 B1
(45) **Date of Patent: *Dec. 11, 2001**

(54) AUTOMATIC LIGHT DIMMER FOR GAS DISCHARGE LAMPS

(76) Inventor: Richard L. Sievers, 378 Placid Cove, New Braunfels, TX (US) 78130

( * ) Notice: Subject to any disclaimer, the term of this patent is extended or adjusted under 35 U.S.C. 154(b) by 0 days.

This patent is subject to a terminal disclaimer.

(21) Appl. No.: 09/558,317

(22) Filed: Apr. 25, 2000

Related U.S. Application Data

(63) Continuation of application No. 08/215,205, filed on Mar. 21, 1994, now Pat. No. 6,124,684, which is a continuation of application No. 07/988,730, filed on Dec. 10, 1992, now abandoned, which is a continuation-in-part of application No. 07/809,388, filed on Dec. 17, 1991, now abandoned.

(51) Int. Cl.[7] ..... H05B 37/02

(52) U.S. Cl. ..... 315/307; 315/276; 315/360; 315/DIG. 4

(58) Field of Search ..... 315/DIG. 4, 205, 315/194, 276, 307, 158, 159, 360

(56) References Cited

U.S. PATENT DOCUMENTS 3,944,876 * 3/1976 Helmuth ..... 315/205

* cited by examiner

*Primary Examiner*—David Vu
(74) *Attorney, Agent, or Firm*—Wayne J. Colton, Inc.

(57) ABSTRACT

A power saving dimming apparatus for gas discharge lamps activates a system of gas discharge lamps through a phototransistor network sensitive to the infrared spectrum rather than the normal visible spectrum. The phototransistor network allows power to be supplied to the apparatus, resulting in the turning on of the lamps whenever daylight conditions exist which are insufficient to produce infrared light. When power is applied to the apparatus, either at initial turn on or after a momentary interruption, the apparatus applies full power to the primaries of the lamp ballasts for a preselected time period, thus ensuring all the lamps in the system light. After the preselected time period has passed, the apparatus automatically dims the lamps and maintains them in the dimmed state.

16 Claims, 6 Drawing Sheets

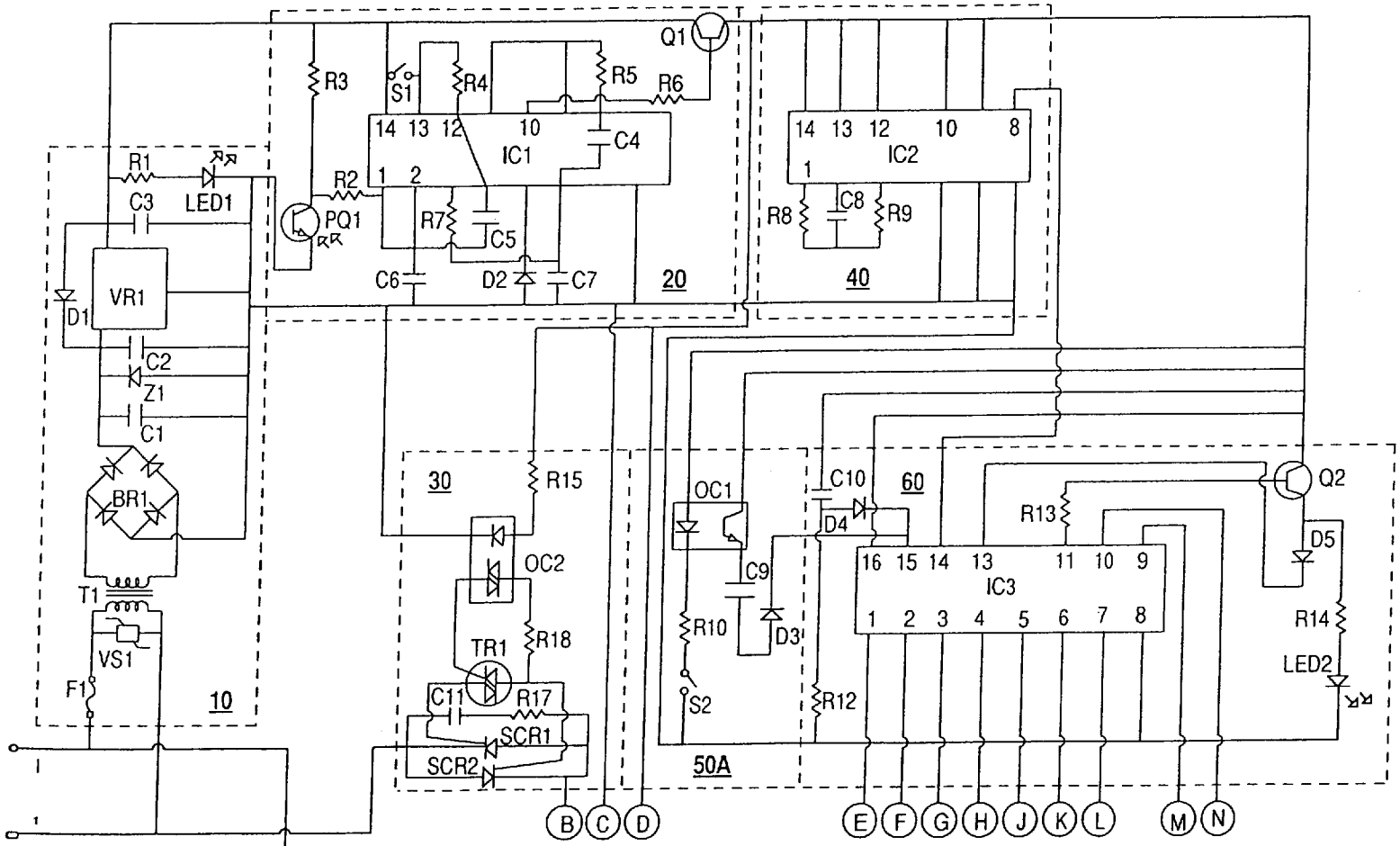
Fig. 5A1

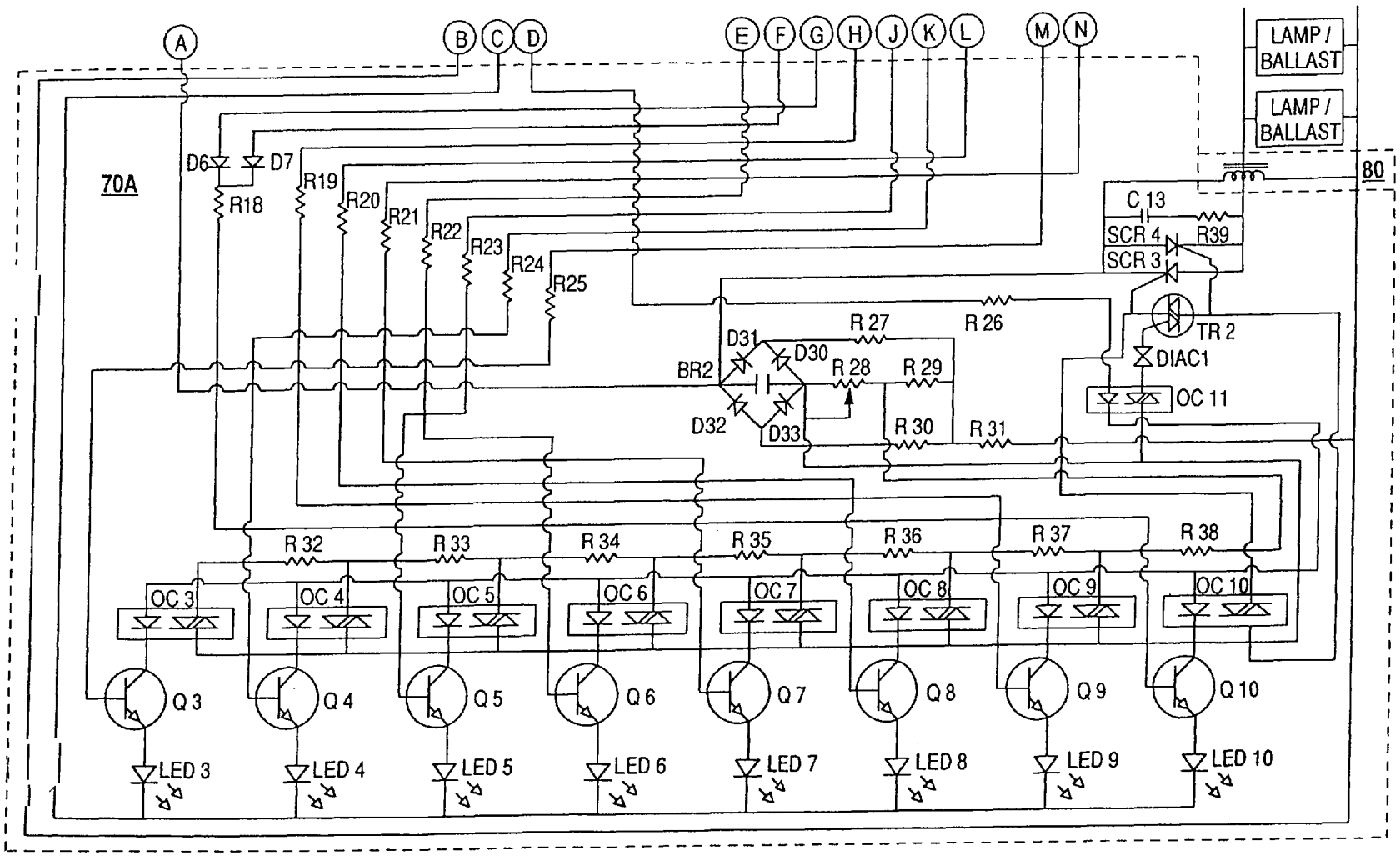
Fig. 5A2

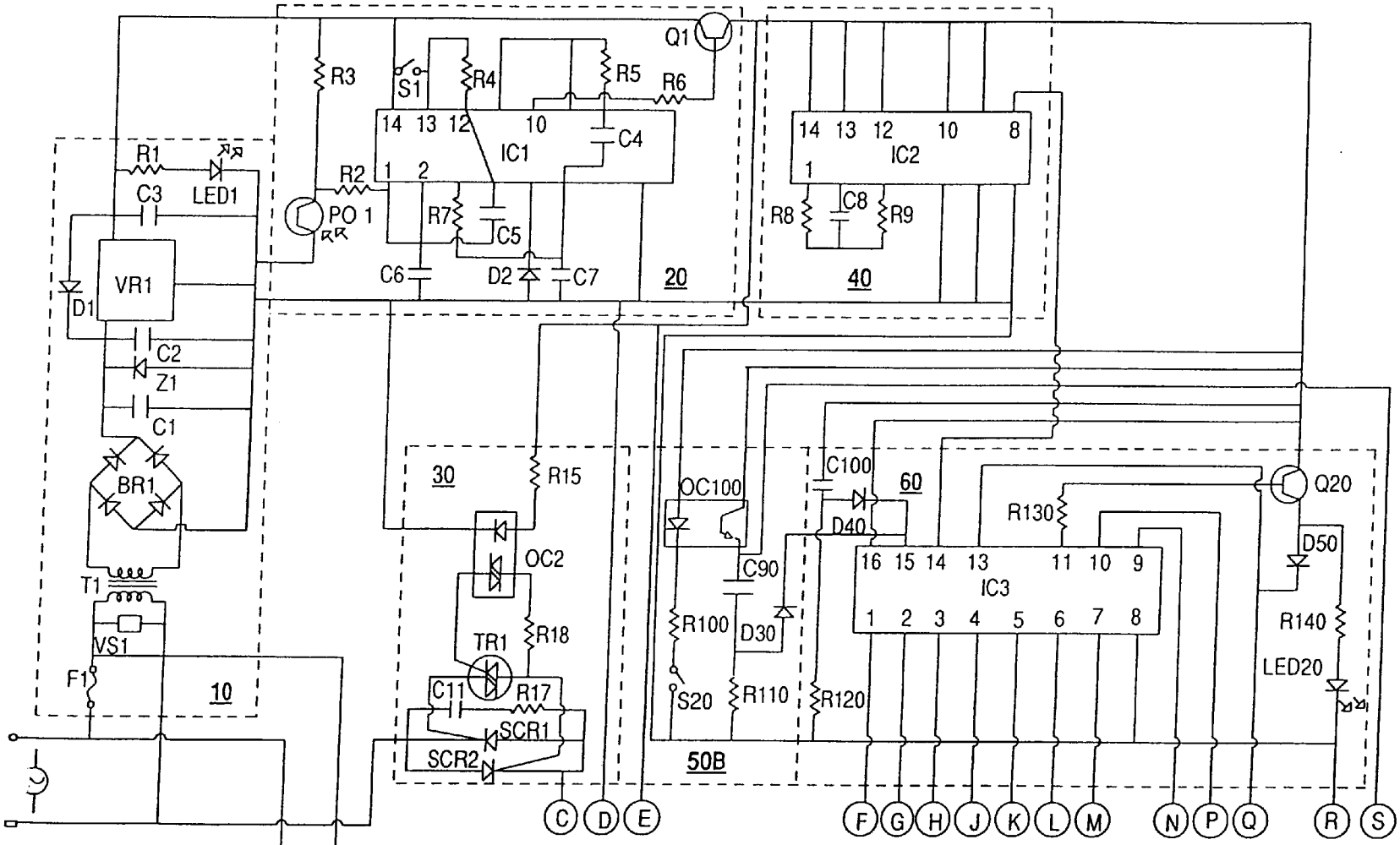
FIG. 5B1

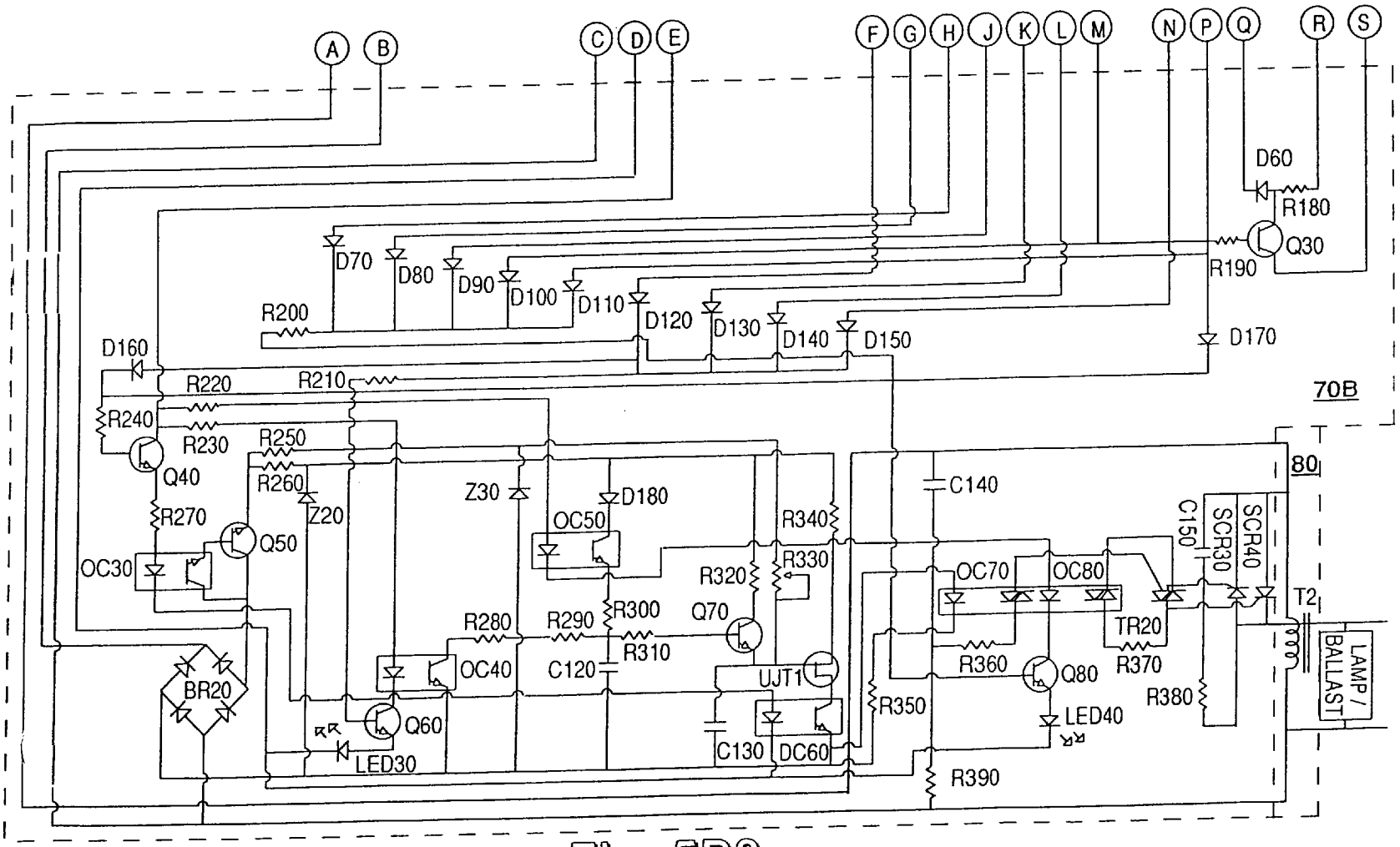
Fig. 5B2

AUTOMATIC LIGHT DIMMER FOR GAS DISCHARGE LAMPS

RELATED APPLICATIONS

This patent application is a continuation of U.S. patent application Ser. No. 08/215,205 filed Mar. 21, 1994, now U.S. Pat. No. 6,124,684 which is a file wrapper continuation of U.S. patent application Ser. No. 07/988,730 filed Dec. 10, 1992 now abandoned, which is a continuation-in-part of U.S. patent application Ser. No. 07/809,388 filed Dec. 17, 1991, now abandoned; the entire disclosures of all applications are expressly incorporated herein by reference.

BACKGROUND OF THE INVENTION

1. Field of the Invention

The present invention relates to an apparatus for automatically controlling the starting and the subsequent dimming of a plurality of gas discharge lamps using standard commercially available lamp/ballast combinations. More specifically, but not by way of limitation, the apparatus allows gas discharge lamps (fluorescent, mercury vapor, metal halide, or high pressure sodium) to be started at full power and then automatically dimmed with no further operator intervention. Furthermore, after power is restored following a momentary power outage, the apparatus will restart the lamps at full power and then automatically readjust them to their prior dimmed setting.

2. Description of the Related Art

Various methods and apparatus presently exist to start gas discharge lamps. One such method starts fluorescent lamps utilizing starter switch "S" connected to both electrodes of a lamp (see FIG. 1). Initially, starter switch "S" is closed in order to conduct the applied electrical current to each electrode. Current is applied directly to each electrode so that the electrodes will be heated to thermionic emission temperature. Once the electrodes reach their thermionic emission temperature, the switch is opened, and the lamp starts.

However, because switches utilized in the above method and apparatus must be periodically replaced, starterless circuits have been devised. A starterless circuit such as that shown in FIG. 2, applies AC current to a lamp ballast which may be either a conventional transformer or an autotransformer. In either case, a portion of the transformer's output is tapped for each electrode to produce a current that heats the electrodes to thermionic emission temperature. Again, once the electrodes reach thermionic emission temperature, the lamps will start.

Gas discharge lamps such as high pressure sodium (HPS) lamps also require a starter switch to provide an initial high voltage pulse across both electrodes of the lamps. In the starter switch shown in FIG. 4, the output of the ballast is applied to an igniter which applies full power to both electrodes of the lamp, thereby heating the electrodes to thermionic emission temperature and starting the lamp.

For reasons of both energy efficiency and consumer preference, it is desirable to incorporate dimming devices into fluorescent and high intensity discharge (HID) lamp circuits. Such dimming devices, which are well known in the art, generally use solid-state components such as silicon controlled rectifiers (SCRs) or triacs to block portions of each half-cycle of the incoming AC voltage. By only allowing portions of each half-cycle to be conducted to the ballast, the amount of power delivered is thereby reduced.

However, a problem with such dimming devices, when applied in gas discharge lamps, is that full power is needed to start each lamp because of their high thermionic emission temperatures, and the particular starters required as discussed above. Additionally, after any power interruption, even a momentary one, all HID lamps (mercury vapor, metal halide, and high pressure sodium) require a cool down period during which full power is supplied before they will restrike. That period varies from about one minute for high pressure sodium lamps to between ten and fifteen minutes for metal halide lamps. Thus, the above dimming devices when activated will not be able to originally start or restart HID lamps. To start the HID lamps, a user must first manually apply full power to the ballast to start the lamps and then manually adjust the dimming device to the desired level. The dimming device, therefore, cannot be left at the desired setting because at every start-up or restart, a manual readjustment is required.

In an attempt to solve the above problem, an apparatus that utilizes special fluorescent ballasts (see FIG. 3) has been developed. The special fluorescent ballasts are provided with sections which continuously furnish power to the cathodes of the lamps, thereby maintaining the thermionic emission temperature of the cathodes. Unfortunately, these devices are costly and require extra wiring to control the dimming of the lamp.

Additionally, other devices currently exist for regulating gas discharge lamps. Such devices are typically installed in series between the ballast and the lamp. These devices range from the addition of one or more capacitors or reactive devices to the installation of more sophisticated solid-state circuitry such as that disclosed in U.S. Pat. No. 4,147,961, issued on Apr. 3, 1979 to Elms, and U.S. Pat. No. 4,147,962, issued on Apr. 3, 1979 to Engel.

Unfortunately, the devices disclosed in the above patents suffer several disadvantages. First, installation requires opening each fixture and installing additional components, thus significantly increasing initial costs. Second, extra control leads may be required in each fixture to allow a variance in the energy savings or lighting levels. That requirement makes a retrofit application very costly because it is often difficult to pull additional conductors through a conduit already filled to capacity. Furthermore, both the lamp fixtures and the conduits could be at a height requiring special equipment for installation. Third, the number and cost of individual components susceptible to failure create maintenance problems. Finally, and most importantly, full power will most likely not be available to the lamps at start up, resulting in a failure of the devices to start the lamps.

A dimming device which attempts to deal with the problem of starting of gas discharge lamps is disclosed in U.S. Pat. No. 4,287,455. The '455 device employs power switch SCRs that are gated by a unijunction transistor via a control switch SCR and a pair of optocouplers. To produce appropriate phase control, the power switch SCRs are non-conducting until the unijunction transistor fires a pulse. The unijunction transistor, however, will not fire until a group of capacitors connected to its emitter are charged to a required value. The charging of the capacitors is accomplished by transforming and rectifying the incoming AC voltage using a transformer and rectifying bridge circuit, and then feeding the rectified voltage to the capacitors through a potentiometer. Thus, the phase portion of the incoming AC voltage which is conducted to the load depends upon the values of the capacitors and the setting of the potentiometer. To provide automatic starting when the device is set to dim the lamps, the capacitors coupled to the unijunction transistor also receive charging current through a charging diode that is further connected to the collector of a starting transistor.

Additionally, a pair of capacitors is connected to the base of the starting transistor. When the pair of capacitors is charged, the transistor is turned on which reverse biases the charging diode, thus, no longer enabling the capacitors connected to the unijunction transistor to be charged via that pathway. Therefore, when power is initially applied to the device, the capacitors coupled to the unijunction transistor are charged via both the charging diode pathway as well as the potentiometer pathway. That supplemental charging causes the triggering of the unijunction transistor earlier in the AC cycle than in normal dimming operation. The '455 device is supposed to deliver enough power to start the lamps before the starting transistor turns on.

However, full power is never directly applied to the load during the starting operation. Instead, the power switch SCRs are simply triggered earlier in the AC half-cycle than in the normal dimming operation. Thus, whether enough power is delivered to start the lamps depends upon the load. That is, with enough lamps connected to the device, it will be unable to supply sufficient power to light all the lamps. In that situation, only full power will start the lamps.

Furthermore, a portion of the charging current for the capacitors connected to the unijunction transistor always flows through the potentiometer. At a high dim setting, the triggering of the unijunction transistor occurs late in the AC cycle, even during the starting operation. Again, depending on the load, the resulting amount of power transmitted may not be enough to start the lamps. Thus, the '455 device makes it impractical to furnish full power to HID lamps for the time necessary to allow the cool-down period before the lamps will restrike. Additionally, the capacitors connected to the starting transistor must discharge enough to turn off the starting transistor before the starting operation can take place. That is supposed to occur whenever power is removed from the device, however, a power outage of sufficiently short duration may extinguish the lamps while preventing the capacitors from sufficiently discharging. In that case, the lamps would have been restarted manually.

Another dimming device is disclosed in U.S. Pat. No. 5,043,635, issued on Aug. 27, 1991 to Talbott. It has similar shortcomings as the device described above. That is, if a power outage of only a few seconds occurs, the lamps under the control of '635 device must be restarted manually.

Another dimming device is disclosed in U.S. Pat. No. 4,950,96 issued to Sievers, the inventor of the present invention. During sustained operation, the '963 device provides lamp dimming by delivering power to the lamp only during portions of the AC cycle. Timing capacitors contained in a bridge circuit, when charged to the threshold voltage of a diac, discharge during a half-cycle into the gate of a triac causing the triac to conduct the incoming AC line to the lamp. Diodes, also contained in the bridge circuit, allow the timing capacitors to be reset during the opposite half-cycle. The '963 device is further provided with potentiometers that are used to adjust the charging times of the charging capacitors and, therefore, the amount by which the lamp is dimmed. However, during system power up or a momentary power failure, the '963 device provides full power to light or relight the lamp. Upon power up, a timer is initialized and begins operation. While the timer is operating, a signal turns on a transistor which turns on an opto-isolator causing the triac to deliver the full wave AC power to the lamp. After the timer times out, the transistor is turned off, thereby allowing the bridge circuit to automatically take over to deliver the reduced AC power.

The '963 device is an improvement over conventional dimming devices because the amount the lamp is dimmed after the full power warm up period expires may be set once and will remain set without further adjustment. Unfortunately, because the '963 device goes from a full power warm up period directly to its dimmed level in a one-step reduction of power, it does not operate properly when used to control HID lamps. When the '963 device is used with high pressure sodium lamps, many lamps may extinguish after the one-step dimming process.

All of the above described dimming devices, by utilizing SCRs or triacs, introduce harmonics into the system and result in low power factor operation of the circuit. Both factors cause problems with the utility company serving the particular installation using a dimming device. In some instances, the use of the dimming devices affects the system to such an extent that additional charges may be accrued which offset any savings realized.

SUMMARY OF THE INVENTION

Therefore, it is an object of the present invention to provide a dimming apparatus, connectable to the primary supply of the ballast of an ordinary gas discharge lamp (fluorescent, mercury vapor, metal halide, or high pressure sodium), which provides a degree of dimming while allowing the lamp to be started at full power utilizing zero-cross electronics. The dimming function may take place step-wise encompassing one or more stages or through a continuous reduction of power as necessary for the proper operation of the lamps.

It is a further object of the present invention to provide a dimming apparatus that applies full power to the lamp or lamps upon initial starting or momentary power interruption with no dependence upon the dimming level or the applied load or the length of interruption.

It is another object of the present invention to provide a dimming apparatus that operates while at full power and in the dimmed mode at an industry accepted high power factor while introducing minimal harmonics to the system.

It is still a further object of the present invention to provide a solid-state light detection circuit utilizing a phototransistor that is only sensitive to the infrared light spectrum.

It is still another object of the present invention to provide a circuit for maintaining full power operation or returning to the lamps to full power from a dimmed state without turning the system off.

Still other features and advantages of the present invention will become evident to those skilled in the art in light of the following.

BRIEF DESCRIPTION OF THE DRAWINGS

FIGS. 5A1 and 5A2 are a schematic diagrams depicting the automatic light dimming system of the present invention in an embodiment which dims mercury vapor, metal halide, or high pressure sodium lamps utilizing a step-wise power reduction.

FIGS. 5B1 and 5B2 are a schematic diagrams depicting the automatic light dimming system of the present invention in an embodiment which dims mercury vapor, metal halide, or high pressure sodium lamps utilizing a continuous power reduction.

DETAILED DESCRIPTION OF THE PREFERRED EMBODIMENT

Figure 1:
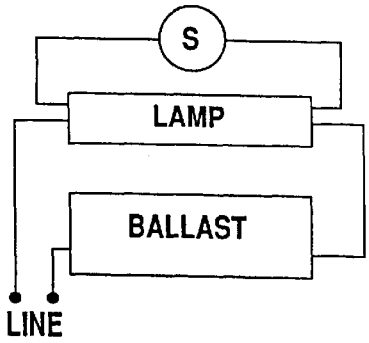
FIG. 1 is a schematic diagram depicting a starter circuit for a fluorescent lamp.
Figure 2:
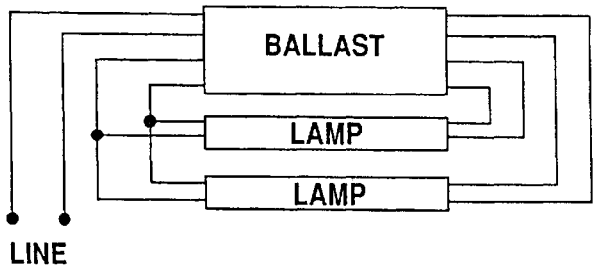
FIG. 2 is a schematic diagram depicting a starterless ballast circuit for a fluorescent lamp.
Figure 3:
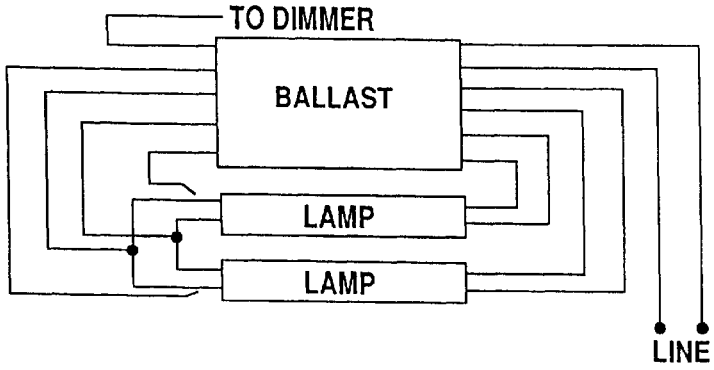
FIG. 3 is a schematic diagram depicting a dimmable ballast circuit for a fluorescent lamp.
Figure 4:
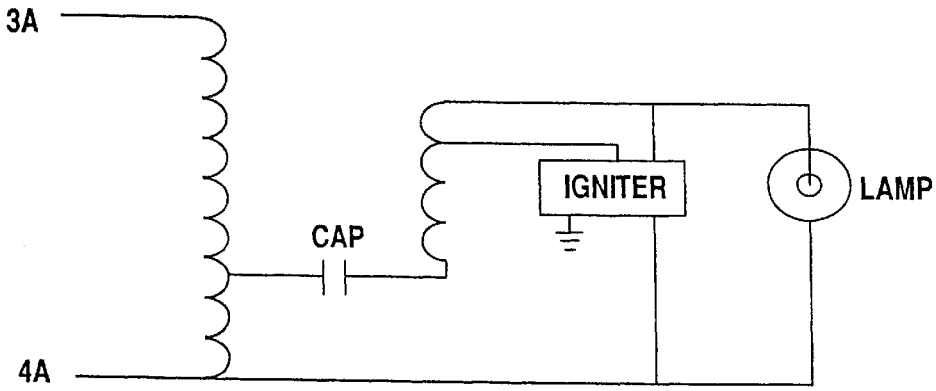
FIG. 4 is a schematic diagram depicting a starter circuit for a high pressure sodium lamp.
Figure 6:
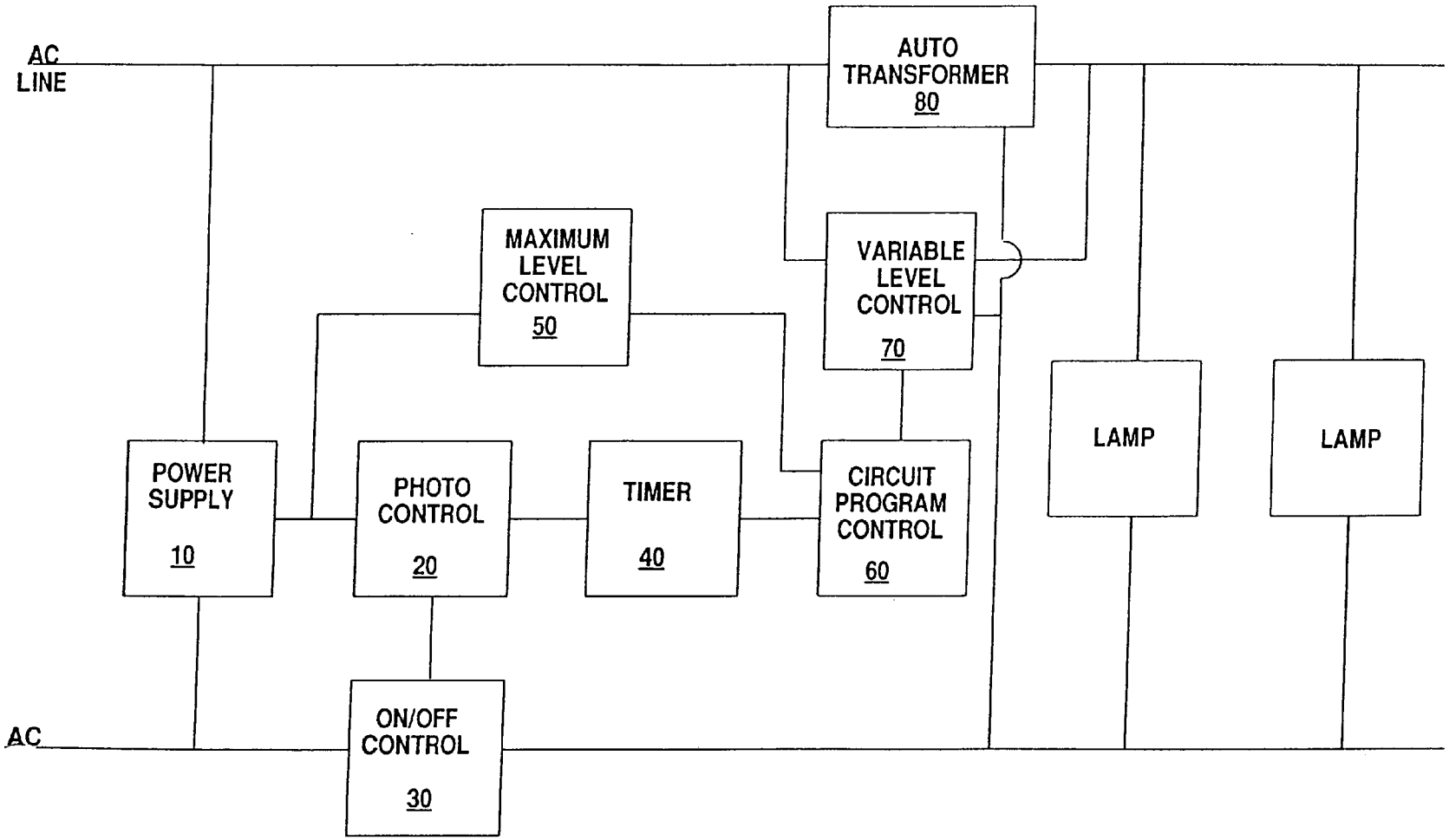
FIG. 6 is a block diagram depicting the component configuration of the automatic light dimming system according to both embodiments of the present invention.

Referring to FIGS. 5A1, 5A2, 5B1, 5B2, and 6, the automatic light dimming system of the present invention will be described. FIGS. 5A1 and 5A2 are a schematic diagrams showing the embodiment of the automatic light dimming system of the present invention which dims mercury vapor, metal halide, or high pressure sodium lamps utilizing a step-wise power reduction. FIGS. 5B1 and 5B2 are a schematic diagrams showing the embodiment of the automatic light dimming system of the present invention which dims mercury vapor, metal halide, or high pressure sodium lamps utilizing a continuous power reduction. In both embodiments of the present invention, power supply 10, photocell control 20, on/off control 30, timer circuit 40, and circuit program control 60 comprise the same circuits (see FIGS. 5A and B). Furthermore, to ensure the automatic light dimming system of the present invention operates independent of the applied load, the AC line voltage is applied directly across variable level control 70 by the current carrying common line (see FIG. 6). That is, variable level control 70 is connected in parallel with autotransformer 80 through its connection to the AC input and the low-voltage tap of autotransformer 80. Additionally, a plurality of lamps are connected across the current carrying common line (see FIG. 6. Each lamp is provided with a ballast (not shown) to provide current regulation.

Power Supply

The incoming AC line voltage is applied to the primary of step-down transformer T1 through a circuit network comprising fuse F1 and transient voltage suppressor VS1 (see FIGS. 5A1 and 5B1). The output from the secondary of T1 is applied to two terminals of full-wave bridge rectifier BR1. The rectified output of rectifier BR1 provides power to photocell control 20, maximum level control 50, on/off control 30, timer circuit 40, circuit program control 60, and variable level control 70 through a voltage regulation network comprising capacitor C1, C2, C3 zener diode Z1, diode D1, and fixed voltage regulator VR1. LED1 receives power from bridge circuit BR1 through resistor R1 and functions to indicate power is available to each of the above control circuits. The negative terminal of BR1 is connected to photocell control 20, on/off control 30, timer 40, maximum level control 50, and circuit program control 60 to form a floating ground which is electrically isolated from the rest of the circuit.

Photocell Control

Photocell control 20 operates to control the application of the output from rectifier BR1 to on/off control 30, timer circuit 40, maximum level control 50, circuit program control 60, and variable level control 70. Photocell control 20 comprises, phototransistor PQ1, transistor Q1, and NOR gate chip IC1 (a National Semiconductor CD4001C NOR gate chip in both embodiments of the present invention). Phototransistor PQ1 comprises an infrared light sensitive transistor positioned remote from both NOR gate chip IC1 and transistor Q1. Phototransistor PQ1 operates in response to available infrared rays to regulate the output from pin 10 of NOR gate chip IC1 in order to control conduction from transistor Q1. The turning on and off of transistor Q1 controls the delivery of power from rectifier BR1 to on/off control 30, timer circuit 40, maximum level control 50, circuit control 60, and variable level control 70. That is, during daylight hours when it is desirable to turn off the lamps, infrared rays which comprise a portion of the light spectrum strike phototransistor PQ1 causing it to turn on. The turning on of phototransistor PQ1 allows current flow through it from the junction of R2 and R3, thus, switching the input of pins 1 and 2 of ICI from a logical "1" state to a logical "0" state. As a result, the output from pin 10 changes to a logical "0", thereby turning off or keeping off Q1. With Q1 turned off, no current flows from rectifier BR1 to on/off control 30, timer circuit 40, maximum level control 50, circuit program control 60, and variable level control 70, and, accordingly, the lamps are turned off and kept off.

Conversely, during the early morning, evening, and night hours, infrared rays cease to strike phototransistor PQ1 because they are either no longer in the light spectrum or the light spectrum has been removed (i.e sundown). Without the infrared rays, phototransistor PQ1 is turned off and current no longer flows through it. Instead, current flows through pins 1 and 2 of chip IC1, thereby, raising their inputs to a logical "1" state. A logical "1" input at pins 1 and 2 of NOR gate chip IC1 results in the output of a logical "1" from pin 10 of NOR gate ICI. Current then flows through R6 to the base of transistor Q1, thus turning it on. With transistor Q1 turned on, current flows through it from rectifier BR1 to on/off control 30, timer circuit 40, maximum level control 50, circuit program control 60, and variable level control 70, and, accordingly, the lamps are turned on and kept on.

Switch S1 is provided to allow manual operation of the system. Closing switch S1, thus coupling pins 13 and 14 together raises the input into pins 12 and 13 to a logical "1" state and causes the output of pin 10 to go high regardless of the status of phototransistor PQ1. Transistor Q1 is then turned on and current flows from the positive terminal of BR1 to on/off control 30, the timer circuit 40, maximum level control 50, circuit program control 60, and variable level control 70. Circumventing phototransistor PQ1 permits manual operation of the system for maintenance or testing purposes.

Additionally, resistor R7 and capacitor C7 form an RC integrator circuit which offers a delay in the activation and deactivation of transistor Q1, thereby preventing momentary changes in infrared ray availability from causing nuisance switching of the system. Furthermore, resistors R4 and R5; capacitors C4, C5, and C6; and diode D2 act as a filtering network to prevent hysteresis.

On/Off Control

On/off control 30 connects the incoming AC line voltage to the lamps in order to turn them on or off. On/off control 30 comprises SCR1 (silicon controlled rectifier), SCR2 (silicon controlled rectifier), triac TR1, and optically isolated triac driver OC2 (a Motorola MOC3021 optically isolated triac driver in both embodiments of the present invention). On/off control 30 turns the system on and off in response to the output from transistor Q1. That is, the emitter of transistor Q1 is connected through resistor R15 to the light emitting diode side of optically isolated triac driver OC2. When transistor Q1 is turned on as described above, current flows through the light emitting diode which drives a phototriac internal to optically isolated triac driver OC2 to deliver voltage to the gate of triac TR1 through resistor R16. As a result, TR1 turns on and conducts current into the gates of SCR1 and SCR2 in order to turn them on. With SCR1 and SCR2 turned on, the current carrying common line is electrically connected to the lamps, and because at this point SCR3 and SCR4 (described herein) are also activated, power will be delivered to the lamps, thus lighting them. Conversely, when transistor Q1 turns off as described above, SVR1 and SCR2 are turned off, thereby breaking the electrical connection between the current carrying common line and the lamps, removing power and causing them to extinguish.

Furthermore, resistor R17 and capacitor C11 are provided to form a snubber network which helps prevent false triggering of the SCRs caused by the lamps which are an inductive circuit. On/off control 30, therefore, serves as a solid-state relay utilizing SCR1 and SCR2 as the main power-handling switching devices.

Timer Circuit

Timer circuit 40 produces a clock signal which is utilized to drive the decade counter/divider which comprises circuit program control 60 (described herein). Timer circuit 40 comprises timer IC2 which in both embodiments of the present invention is a National Semiconductor CD4541B programmable timer. Timer IC2 contains an internal oscillator circuit designed for use with an external capacitor and two resistors designated in FIGS. 5A and B as capacitor C8 and resistors R8 and R9, respectively. The RC network of capacitor C8 and resistors RS and R9 operates to determine the frequency of the internal oscillator which drives the internal counter of timer IC2. Power for timer IC2 is supplied at pin 14 from the emitter of transistor Q1 when it is turned on as described above. Furthermore, pins 12 and 13 are connected to the emitter of transistor Q1 in order to select the counter state internal to timer IC2 which divides the oscillator frequency by $2^{16}$, thereby producing a clock signal from pin 8 having the desired period. Pin 10 is connected to transistor Q1 to control the multicycle mode operation of timer IC2. When the internal counter of timer IC2 times out, the output of timer IC2 at pin 8 changes state. The timed out output at pin 8 has been selected to be high (logical "1"). Thus, as the counter continually sets, times out, and resets, the output from pin 8 constantly changes state, thereby producing a clock signal which is fed into pin 14 of decade counter IC3 in order to control circuit program control 60.

Circuit Program Control

In both embodiments of the present invention, circuit program control 60 comprises decade counter IC3, which is a National Semiconductor CD4017B decade counter/divider having 10 sequentially activated outputs. These outputs which will be referred to as decade counter outputs "0–9" correspond to pins 3, 2, 4, 7, 10, 1, 5, 6, 9, and 11 of decade counter IC3, respectively. Decade counter outputs "0–9" are normally in the logical "0" or low state and only advance to a logical "1" or high state when activated by decade counter IC3. During operation, decade counter IC3 sequentially activates and then subsequently deactivates each one of decade counter outputs "0–9" in response to the positive/leading edges of the clock signal input into its pin 14 from pin 8 of timer IC2. Thus, each one of decade counter outputs "0–9" is sequentially activated to produce a high signal for one full clock cycle (i.e., clock period).

Specifically, for the beginning of a sequence, once decade counter IC3 receives a positive edge of the clock signal input from timer IC2, it activates decade counter output "0", thereby producing a logical "1" or high output on pin 3. At the receipt of the next positive edge of the clock signal, decade counter output "0" is deactivated, thus placing a logical "0" back on pin 3, and decade counter output "1" is activated to produce a logical "1" or high output on pin 2. Accordingly, as each subsequent positive edge of the input clock signal is received, decade counter IC3 deactivates the presently activated decade counter output and activates the next decade counter output in the sequence. In normal operation, decade counter IC3 continually sequences from decade counter output "0" to decade counter output "9" and then back to decade counter output "0" so that another full sequence may begin.

However, in both embodiments of the present invention, only one progression from decade counter output "0" to decade counter output "9" is desired. Accordingly, decade counter output "9" is connected to the base of transistor Q2 through resistor R13. Thus, when decade counter output "9", the last output in the sequence, is activated, a logical "1" is applied to the base of Q2, thereby turning it on. With transistor Q2 turned on, current from the emitter of Q1 flows through Q2 and diode D5 to apply a logical "1" to pin 13. A high input at pin 13 causes decade counter IC3 to "freeze" in its present state. That is, decade counter IC3 will not sequence through decade counter outputs "0–9" as long as pin 13 receives a high input. Decade counter IC3, therefore, will effectively be held with decade counter output "9" (pin 11) activated, and the rest of decade counter outputs "0–8" deactivated until decade counter IC3 receives a reset signal.

Pin 15 of decade counter IC3 is the decade counter reset. Upon the receipt of a reset signal at pin 15, decade counter IC3 deactivates decade counter output "9" or, alternatively, any one of decade counter outputs "0–8" which is presently activated. Decade counter IC3 will then perform a completely new sequence, starting with decade counter output "0" and finishing with decade counter output "9" as described above.

However, if the reset signal is received from maximum level control 50 (described herein), decade counter IC3 will not sequence but will, instead, "freeze") with either decade counter output "0" or decade counter output "13" activated, thus permitting continuous delivery of full power to the lamps. Full power will be supplied to the lamps until maximum level control 50 is removed from the system. Once maximum level control 50 is removed from the system, decade counter IC3 will perform another complete sequence as described above.

Pin 15 of decade counter IC3 is further connected to the emitter of Q1 through the RC differentiator network of capacitor CI10 and resistor R12 by way of diode D4 to provide resetting of decade counter IC3 upon either initial power application or the reapplication of power when a momentary power outage has occurred. Upon the application of power, transistor Q1 will provide a logical "1" or a high signal to pin 15 because C10 is initially discharged and cannot charge instantaneously. That is, the time period during which C10 charges is sufficient to provide a reset signal to decade counter IC3. However, once C10 fully charges, current no longer flows to pin 15, thus removing the logical "1" and permitting decade counter IC3 to begin operation under control of the clock signal from timer IC2 as previously described.

The emitter of Q1 is further connected to pin 16 of decade counter IC3 in order to supply power to the chip. Pin 8 functions as the ground pin and, thus, is connected to the floating ground formed at the negative terminal of bridge rectifier BR1.

Autotransformer

Autotransformer 80 is connected in parallel with variable level control 70 and functions to supply voltage to the lamps at a reduced level once variable level control 70 (described herein) has been removed from the system. After variable level control 70 has been turned off, autotransformer 80 assumes all responsibility for the delivery of voltage to the lamps. Autotransformer 80 will maintain the lamps lit at their minimum lighting level until a system reset, a power outage followed by return of power, or the activation of maximum level control 50. If any of the above occur, variable level control 70 will be activated to start the lamps at full power and then dim them as described herein. Autotransformer 80 offers high-power-factor operation while eliminating the possible problems encountered by the harmonic distortion introduced by the phase-control SCRs in the dimming system.

Variable Level Control (A)

As discussed previously, if a one-step reduction in voltage were employed such as in the case of immediately switching in autotransformer 80 after a full power start-up, loss of the arc in the HID lamps most likely will result. Accordingly, variable level control 70A (See FIG. 5A2) is placed in parallel with the high input and low output terminals of autotransformer 80 to function as a solid-state means whereby the power delivered to the lamps may be reduced from full to partial over a period of time.

Referring specifically to FIG. 5A2, the embodiment of variable level control 70 which utilizes step-wise control of the dimming from a full-power level to a dimmed level as established by autotransformer 80 will be described. Full power lighting of the lamps followed by a step-wise reduction is performed by variable level control 70A (FIG. 5A2) under the control of circuit program control 60. To allow for the initial full-power starting of the lamps, the base of transistor Q10 is connected through resistor R18 and diodes D6 and D7 to decade counter output "0" (pin 3) and decade counter output "1" (pin 2) of decade counter IC3. The collector of transistor Q10 is connected to the cathode of the LED portion of optically isolated zero-crossing triac driver OCl0, which in this embodiment, is a Motorola MOC3043 triac driver. The anode of the LED portion of optically isolated zero-crossing triac driver OC10 is connected to the cathode of the LED portion of optically isolated triac driver OC11, which in this embodiment is a Motorola MOC3012 optically isolated triac driver. In turn, the anode the LED portion of optically isolated triac driver OC11 is connected to the emitter of transistor Q1 through resistor R26. The emitter of transistor Q10 is connected to LED 10 which, in turn, is connected to ground and functions to indicate the system is operating at full power.

Upon the application of power to the system through transistor Q1 as previously described, decade counter IC3 is triggered by timer IC2 to activate decade counter output "0". When decade counter output "0" is high, current flows to the base of transistor Q10 turning it on. With transistor Q10 turned on, a complete current path exists which permits current to flow from transistor Q1 through the LED portion of optically isolated triac driver OC11 to the LED portion of optically isolated triac driver OC10, thus lighting the LED portion of optically isolated triac driver OC10. The lighting of the LED portion of optically isolated triac driver OC10, in turn, causes the phototriac internal to optically isolated triac driver OC10 to activate and, thus, deliver voltage to the gates of SCR3 and SCR4, thereby turning them on. As previously described with reference to on/off control 30, SCR1 and SCR2 are also turned on in response to system activation. Therefore, because SCR1 and SCR2 are always on and SCR3 and SCR4 have been turned on, power from the incoming AC line is delivered to the lamps. Furthermore, full power is applied to the lamps because with both decade counter outputs "0" and "1" connected to the base of transistor Q10, transistor Q10 remains on and, thus, SCR3 and SCR4 remain on for a time period sufficient to deliver full-wave AC voltage. That is, even though decade counter IC3 progresses from decade counter output "0" (pin 3) to decade counter output "1" (pin 2) as previously described, transistor Q10 will remain on, thereby maintaining SCR3 and SCR4 for a time period sufficient to ensure that full power start-up of the lamps occurs.

Capacitor C13 and resistor R39 form a snubbing network to prevent false triggering of SCR3 and SCR4 caused by the inductive load (i.e. the lamps). Furthermore, triac driver OC10 is employed in this embodiment because its zero-crossing feature only allows SCR3 and SCR4 to turn on at the zero voltage point of the incoming AC voltage, which facilitates the supply of full RMS voltage to the system while at the same time prevents damage to individual system components caused as a result of system start-up at the peak voltage point of the incoming AC voltage.

The progression of decade counter IC3 from decade counter output "1" (pin 2) to decade counter output "2" (Pin 4) turns off transistor Q10 which removes full power from the lamps and allows activation of the step-wise power reduction circuit of variable level control 70A. Once transistor Q10 is turned off, the incoming AC line no longer delivers full wave AC voltage to the lamps. Instead, the incoming AC line delivers the AC voltage to the lamps in partial waveforms under the control of bridge circuit BR2 Bridge circuit BR2 is connected between the terminals of the incoming AC line and functions in conjunction with triac TR2; diac 1; and the network formed by transistors Q3–Q9, optically isolated triac drivers OC3–OC9, and resistors R32–R38 to turn on SCR3 and SCR4 only during portions of each half-cycle of the incoming AC voltage waveform, thus facilitating the application of reduced power to the lamps.

Bridge circuit BR2 comprises timing capacitor C12 and the resistor network of potentiometer R28 and resistors R31 and R29, which connects timing capacitor C12 to the AC input line. Bridge circuit BR2 further comprises diodes D30–D33 and resistors R27 and R30 which cause timing capacitor C12 to be reset to the same voltage level after each positive or negative half-cycle of the incoming AC voltage, thus reducing the hysteresis effect. The delivery of AC voltage to bridge circuit BR2 results in the charging of timing capacitor C12. Once timing capacitor C12 charges to the breakover voltage of diac 1 during either the positive or negative half of the AC cycle, diac 1 turns on. The amount of time required to charge timing capacitor C12 to the breakover voltage of diac 1 is regulated by the voltage-dropping network comprised of potentiometer R28 and resistors R31 and R29 as well as parallel resistors R33–R39 (described herein). With diac 1 turned on, timing capacitor C12 discharges into the gate of triac TR2 through optically isolated triac driver OC11 and diac 1, resulting in the turning on of triac TR2. The turning on of triac TR2 allows it to apply the incoming AC voltage to the gates of SCR3 and SCR4, thereby turning them on. Once SCR3 and SCR4 are turned on, the incoming AC voltage is applied directly across the lamps. However, because SCR3 and SCR4 turn off at zero current, i.e. when the incoming AC signal reaches zero as it changes polarity, only a portion of the incoming AC waveform is conducted to the lamps. That is, when SCR3 and SCR4 are activated, the portion of the incoming AC voltage signal, either the positive or negative half-cycle, remaining from the point of activation of the SCRs to the zero current or crossover point of the AC signal is conducted to the lamps. SCR3 and SCR4 are activated along the incoming half-cycle of the AC signal because a portion of that half-cycle signal is used to charge timing capacitor C12 to the breakover voltage of diac 1. Accordingly, variable level control 70A provides reduced power and, thus dimming to the lamps.

The bases of transistors Q9–Q3 are connected through resistors R19–R25, respectively, to decade counter outputs "2–8", respectively. The emitters of transistors Q9–Q3 are connected to LEDs 9–3, respectively, which in turn are connected to ground and function to indicate the specific transistor activated. The collectors of transistors Q9–Q3 are connected to the cathodes of the LED portions of optically isolated triac drivers OC9–OC3, respectively. In this embodiment, optically isolated triac drivers OC9–OC3 are Motorola MOC3012 optically isolated triac drivers. Similarly to optically isolated triac driver OC10, the anodes of the LED portions of optically isolated triac drivers OC9–OC3 are connected to the cathode of the LED portion of optically isolated triac driver OC11. Additionally, the phototriacs internal to optically isolated triac drivers OC9–OC3 are connected along different points of the resistor network comprising resistors R38–R32 in order to provide a variable resistance to bridge circuit BR2.

In operation, variable level control 70A functions to reduce the power delivered from the incoming AC line in a step-wise fashion so that the light output of the lamps will gradually be reduced to an operator-selected dimmed level. To accomplish the delivery of reduced power, variable level control 70A changes the charging time of timing capacitor C12 in multiple steps specifically, as described above, the charging of timing capacitor C12 to the breakover voltage of diac 1 controls when SCR3 and SCR4 are activated. Thus, by step-wise increasing the time required for timing capacitor C12 to reach the breakover voltage of diac 1, variable level control 70A activates SCR3 and SCR4 at discrete points which occur consistently later along the half-cycle of the incoming AC signal. Accordingly, as SCR3 and SCR4 are consistently fired later and later along the half-cycle of the incoming AC signal, the power delivered to the lamps is reduced to the operator-selected value.

The level to which the lamps are dimmed is determined by the resistance value to which potentiometer R28 is adjusted. That is, as the resistance of potentiometer R28 is increased, the charging time of timing capacitor C12 increases. That results in the firing of SCR3 and SCR4 at a point later along the half-cycle of the incoming AC signal. Thus, when potentiometer R28 is adjusted to it maximum resistance level, the lamps are provided with the least power and, therefore, are the most dimmed. Furthermore, the altering of the resistance encountered by bridge circuit BR2 as it charges timing capacitor C12 provides the step-wise reduction of the power delivered to the lamps.

Specifically, when decade counter output "1" (pin 2) is deactivated and decade counter output "2" (pin 4) is activated, full power start-up of the lamps is finished, and the step-wise reduction of power begins. With decade counter output "2" (pin 4) advanced to a high state by decade counter IC3, current flows to the base of transistor Q9, turning it on. The activation of transistor Q9 allows current to flow through the LED portion of optically isolated triac driver OC9 from transistor Q1. The lighting of the LED portion of optically isolated triac driver OC9 activates the phototriac internal to OC9 and switches resistor R38 into bridge circuit BR2. The added resistance of resistor R38 in bridge circuit BR2 increases the time required for timing capacitor C12 to charge to the breakover voltage of diac 1. Consequently, SCR3 and SCR4 are fired after the beginning of the incoming AC signal half-cycle, resulting in less than full power being applied to the lamps. However, the resistance value of resistor R38 is such that the charging time of timing capacitor C12 is not greatly affected, and therefore, a large portion of the AC signal is conducted to the lamps.

When decade counter output "2" (pin 4) is deactivated and decade counter output "3" (pin 7) is activated, transistor Q9 turns off, and current flows to the base of transistor Q8, turning it on. The activation of transistor Q8 allows current to flow through the LED portion of optically isolated triac driver OC8 from transistor Q1. The lighting of the LED portion of optically isolated triac driver OC8 activates the phototriac internal to OC8 and switches both resistors R38 and R37 into bridge circuit BR2. The added resistance of resistors R38 and R37 in bridge circuit BR2 again increases the time required for timing capacitor to charge to the breakover voltage of diac 1. Consequently, SCR3 and SCR4 are fired later than before in the incoming AC signal half-cycle, resulting in even less power being applied to the lamps.

As decade counter IC3 progresses to decade counter output "4", resistor R36 is added to bridge circuit BR2, and the time required to charge timing capacitor C12 to the breakover voltage of diac 1 again increases. SCR3 and SCR4 are turned on later in the AC half-cycle and even less power is delivered to the lamps.

As decade counter IC3 progresses through decade counter outputs 5–8, resistors R35–R32 are sequentially added to bridge circuit BR2 similar to the addition of resistors R38–R36 as described above. With each added resistance, the charging time of capacitor C12 is increased, resulting in less and less power being delivered to the lamps as SCR3 and SCR4 are switched on later and later in the AC half-cycle. When decade counter IC3 finally reaches decade counter output "8", the lamps are dimmed to the level set by potentiometer R28. Accordingly, as decade counter IC3 progresses through its decade counter output sequence, power to the lamps is reduced in a step-wise fashion as a result of the switching in of resistors R38–R32.

However, when decade counter IC3 advances to decade counter output "9" (pin 11), the sequencing of decade counter IC3 ceases and decade counter outputs "0–8" are locked in their low state as previously described in the description of decade counter IC3.

With decade counter outputs "0–8" turned off, transistors Q10–Q3 are turned off, effectively removing variable level control 70A from the system. With variable level control 70A removed from the system, autotransformer 80 takes over to deliver the reduced power to the lamps as described above. Furthermore, removal of variable level control 70A is desirable because all of its heat-generating devices are off and will only be activated during actual operation of variable level control 70A.

When decade counter output "9" (pin 11) of decade counter IC3 is activated, variable level control 70A is removed from the system because the base of transistor Q2 is connected to decade counter output "9" (pin 11) of decade counter IC3 through resistor R13. With decade counter output "9" (pin 11) activated, current flows through resistor R13 to the base of transistor Q2, thereby turning it on. With transistor Q2 on, current flows from the emitter of Q1 through diode D5 to pin 13 of decade counter IC3 causing decade counter IC3 to "lock" with decade counter output "9" (pin 11) activated, current from transistor Q1 also flows through resistor R14 to LED2, which is connected to ground and functions to indicate the system is operating in a reduced power mode.

Maximum Level Control Means (A)

FIG. 5A2 shows maximum level control 50A used with the step-wise power reduction circuit of variable level control 70A. Maximum level control 50A comprises optically isolated transistor OC1, current limiting resistor R10, switch S2, and diode D3. In this embodiment, OC1 is a Motorola 4N35 optically isolated transistor. The anode of the internal LED of optically isolated transistor OC1 is connected to the emitter of Transistor Q1. When switch S2 is closed, current flows through the internal LED of optically isolated transistor OC1, thus activating the phototransistor internal to optically isolated transistor OC1. With the phototransistor internal to optically isolated transistor OC1 activated, current flows from the emitter of optically isolated transistor OC1 through D3 to pin 15 of decade counter IC3. A high signal applied to pin 15 causes decade counter IC3 to reset, thereby activating decade counter output "0" (pin 3). Furthermore, as long as switch S2 remains closed, decade counter IC3 will remain locked with decade counter output "0" activated. As previously described, a high signal from decade counter output "0" will result in full power being applied to the lamps. Therefore, the lamps will remain fully lit until switch S2 is opened.

In this embodiment, switch S2 may comprise a manually operated switch, an electrically operated switch connected to a time clock, a computer operated relay, or a photocell. For example, an electrically operated switch such as a solenoid activated switch could be connected to a time clock which activates and deactivates the solenoid at certain times to regulate full power operation of the lamps. That is, at a certain time in the mid-morning, the clock could turn off the solenoid which opens the switch and allows the lamps to be dimmed using variable level control 70A as described above. However, at a certain time in the evening, the clock could activate the solenoid which closes the switch and brings the lamps up to full power as described above.

Variable Level Control Level Means (B)

Again as discussed previously, if a one-step reduction in voltage were employed such as in the case of immediately switching in autotransformer 80 after a full power start-up, loss of the arc in the HID lamps most likely will result. Accordingly, variable level control 70B is placed in parallel with the high input and low output terminals of autotransformer 80 to function as a solid-state means whereby the power delivered to the lamps may be reduced from full to partial over a period of time.

Referring specifically to FIG. 5B2, the embodiment of variable level control 70 which utilizes continuous control of the dimming from a full-power level to a dimmed level as established by autotransformer 80 will be described. To allow for the initial full-power starting of the lamps, the base of transistor Q8 is connected through resistor R200 to diodes D70–D110 which, in turn, are connected to decade counter outputs "0–4" of decade counter IC3, respectively. The emitter of transistor Q80 is connected to ground through LED 40, which functions to indicate the system is operating at full power. The collector of transistor Q80 is connected to the cathode of the LED portion of optically isolated zero-crossing triac driver OC80, which in this embodiment is a Motorola MOC3043 optically isolated zero-crossing triac driver. The anode of the LED portion of optically isolated zero-crossing triac driver OC80 is connected to the cathode of the LED portion of optically isolated transistor OC5 which in this embodiment is a Motorola 4N35 optically isolated transistor. The anode of the LED portion of optically isolated transistor OC50 is connected through resistor R22 to the emitter of transistor Q1.

With either an initial application of power or a system reset as described above, transistor Q1 turns on to provide system power. As a result, decade counter IC3 under the control of timer IC2 begins its sequence at decade counter output "0". A high output from decade counter output "0" delivers current to the base of transistor Q80, thus turning it on. The activation of transistor Q8 allows current to flow from the emitter of transistor Q1 to the LED portion of optically isolated transistor OC50 through resistor R220, and then to the LED portion of optically isolated zero-crossing triac driver OC8. The lighting of the LED portion of optically isolated zero-crossing triac driver OC80, in turn, activates the phototriac internal to optically isolated zero-crossing triac driver OC80 to apply voltage across the gates of SCR30 and SCR40, thus turning them on. As previously described with reference to on/off control 30, SCR1 and SCR2 are also turned on in response to system activation. Therefore, because SVR1 and SCR2 are always on and SCR30 and SCR40 have been turned on, power from the incoming AC line is delivered to the lamps. Furthermore, full power is applied to the lamps because with decade counter outputs "0–4" connected to the base of transistor Q80, transistor Q80 remains on for four decade counter sequences, resulting in SCR30 and SCR40 remaining on for a time period sufficient to deliver full wave AC voltage. That is, even though decade counter IC3 progresses from decade counter output "0" to decade counter output "4" as previously described, transistor Q80 will remain on, thereby maintaining SCR30 and SCR40 for a time period sufficient to ensure that full power start-up of the lamps occurs.

Capacitor C150 and Resistor R380 form a snubbing network that prevents false triggering of SCR30 and SCR40 caused by the lamps which are an inductive load. Furthermore, optically isolated zero-crossing triac driver OC80 is employed in this embodiment because its zero-crossing feature only allows SCR30 and SCR40 to turn on at the zero voltage point of the incoming AC voltage signal, which facilitates the supply of full RMS voltage to the system while at the same time prevents damage to individual system components caused as a result of system start-up at the peak voltage point of the incoming AC voltage signal.

In addition to its connection to the base of transistor Q8, decade counter output "4" (pin 10) is connected to the base of transistor Q4 through diode D170 and resistor R240. Thus, when decade counter output "4" is activated by decade counter IC3, transistor Q80 not only remains on as described above but transistor Q40 is also turned on. With transistor Q40 turned on, current from transistor Q1 flows through transistor Q40 to the LED portion of optically isolated transistor OC30 and then to the LED portion of optically isolated transistor OC60 in order to activate both optically isolated transistors. In this embodiment, optically isolated transistor OC30 is a Motorola H11D1 optically isolated transistor, while optically isolated transistor OC60 is a Motorola 4N35 optically isolated transistor. The activation of optically isolated transistor OC30 permits bridge rectifier BR20 to supply current to the base of transistor Q50 through the phototransistor internal to optically isolated transistor OC30. Bridge rectifier BR2, further, supplies current through transistor Q50 to the phase control circuit (described herein) of variable level control 70B.

Supply of current to the phase control circuit during the activation of decade counter output "4" permits charging of capacitor C120 to its full charge because optically isolated transistor OC50 is already activated, as previously described. Bridge rectifier BR20, therefore, charges C120 through transistor Q50, resistor R280, diode D180, the phototransistor internal to optically isolated transistor OC50, and resistor R300 to a voltage level as determined by zener diode Z20. Accordingly, upon the deactivation of decade counter output "4" the phase-control circuit is ready to begin operation at its maximum setting because capacitor C120 has been fully charged to the voltage level determined by zener diode Z20.

The progression of decade counter IC3 from decade counter output "4" (pin 10) to decade counter output "5" (pin 1) removes current from the base of transistor Q80. With transistor Q8 turned off, full power is no longer supplied to the lamps because the incoming AC line no longer delivers full wave AC voltage to the lamps. Instead, the incoming AC line delivers the AC voltage to the lamps, in partial waveforms under the control of the phase control circuit of variable level control 70B.

Specifically, the deactivation of decade counter output "4" (pin 10) and the activation of decade counter output "5" (pin 1) removes current from optically isolated transistor OC50 and stops the charging of capacitor C120. Decade counter output "5" (pin 1) is also connected to the base of transistor Q40 through diodes D120 and D160 and resistor R240 and, therefore, maintains transistor Q40 turned on to provide current to the phase control circuit from bridge rectifier BR20 as previously described. Furthermore, decade counter output "5" (pin 1) is connected to the base of transistor Q60 to turn it on. With transistor Q60 turned on, current flows from transistor Q1 to the LED portion of optically isolated transistor OC40, thus activating it. That current flow also lights LED 30 to indicate the phase control circuit of variable level control 70B is operating.

Phase control of triac TR20 is obtained by charging capacitor C130 through resistor R250 and potentiometer R330 from the voltage level established by zener diode Z30. When capacitor C130 has charged to the firing voltage (i.e. the peak voltage) of unijunction transistor UJT1, unijunction transistor UJT1 turns on, resulting in the discharge of C130 through the emitter of unijunction transistor UJT1. C130 discharges through unijunction transistor UJT1 until the voltage it develops drops below the cut-off (i.e. the valley voltage) of unijunction transistor UJT1. The discharge of capacitor C130 through unijunction transistor UJT1 creates a pulse signal which activates the LED portion of optically isolated triac driver OC70 via optically isolated transistor OC60 and resistor R350. Current flows through the phototransistor internal to optically isolated transistor OC60 because it was previously activated as described above. In this embodiment, optically isolated triac driver OC70 is a Motorola MOC3021 optically isolated triac driver. With optically isolated triac driver OC70 pulsed on, resistors R350 and R390 and capacitor C140 provide the filtered AC gate voltage which is necessary to activate triac TR20. The activation of triac TR20 causes it to apply the incoming AC voltage across the gates of SCR30 and SCR40, thus turning them on. As a result of SCR30 and SCR40 being turned on, the incoming AC signal is conducted to the lamps.

However, because SCR30 and SCR40 turn off at zero current, i.e. when the incoming AC signal reaches zero as it changes polarity, only a portion of the incoming AC waveform is conducted to the lamps to keep them lit. That is, when SCR30 and SCR40 are activated, the portion of the incoming AC signal, either the positive or negative half-cycle, remaining from the point of activation of the SCRs to the zero current or crossover point of the AC signal is conducted to the lamps. After SCR30 and SCR40 turn off at the zero current point, the above cycle repeats. Capacitor C130 continues to charge until it fires unijunction transistor UJT1, which activates SCR30 and SCR40 at a point along the next half-cycle of the incoming AC signal in order to conduct a partial waveform as described above. Accordingly, with the phase control circuit activated, only partial power is applied to the lamps through SCR30 and SCR40.

To provide control of the amount of power delivered to the lamps, or in other words, to control the amount by which the lamps are dimmed, the phase control circuit is supplied with potentiometer R330. The value to which potentiometer R330 is adjusted determines the time required for capacitor C130 to charge to the firing voltage of unijunction transistor UJT1, which in turn, governs the point along the incoming AC signal where SCR30 and SCR40 will be activated. For example, the greater the resistance of potentiometer R330, the longer the time required for capacitor C13 to charge to the firing voltage of unijunction transistor UJT1. Accordingly, the point at which SCR30 and SCR40 turn on and, thus, the amount of power delivered to the lamps is controlled by adjusting the value of the resistance of potentiometer R330.

However, at initial start-up or restart after a momentary power loss, it is necessary to start at full power. Furthermore, it is necessary to gradually reduce the power to the desired dimming level to which potentiometer R330 is adjusted because if potentiometer R330 was adjusted to provide a large amount of dimming, and such a dimming was executed in a single drastic power reduction, the lamps would most likely extinguish. To solve the above problem, capacitor C120 is charged during the full power starting of the lamps as described above to provide a continuous and smooth power reduction to the dimming level set by the adjustment of potentiometer R330. Specifically, when decade counter IC3 advances from decade counter output "4" (pin 10) to decade counter output "5" (pin 1), capacitor C120 is fully charged and, therefore, provides biasing voltage and current to transistor Q70 in order to turn it on. Furthermore, because optically isolated transistor OC40 has been turned on as previously described, capacitor C120 also discharges through resistors R280 and R290 and the phototransistor internal to optically isolated transistor OC40 to ground. That discharge rate is determined by the values of R280 and R290. As C120 discharges, transistor Q70 provides voltage and current to capacitor C130 in addition to the voltage and current provided by bridge rectifier BR20 via transistor Q50, resistor R250, and potentiometer R330. As a result of the increased voltage and current, capacitor C130 charges to the firing voltage of unijunction transistor UJT1 more quickly than if voltage and current were only supplied via the circuit path containing potentiometer R330. When unijunction transistor UJT1 fires, both capacitor C120, via transistor Q70, and capacitor C130 discharge into the emitter of unijunction transistor UJT1 to create the pulse current which causes the activation of SCR3 and SCR4. Initially, as C120 is more fully charged, it provides more voltage and current to capacitor C130, and consequently, unijunction transistor UJT1 fires quickly. As a result, a large portion of the half-cycle of the incoming AC signal is delivered to the lamps. However, as C120 discharges, the voltage and current it supplies gradually decreases which causes capacitor C130 to charge more and more slowly, thus causing SCR30 and SCR40 to gradually be turned on later and later along each half-cycle of the incoming AC signal. Finally, when capacitor C120 is discharged, transistor Q70 turns off and capacitor C130 only charges via the circuit path including potentiometer R330 as previously described. By using capacitor C120 to alter the firing of unijunction transistor UJT1, SCR30 and SCR40 may be initially fired early in each half-cycle of the incoming AC signal and then fired at points later in each half-cycle, until finally capacitor C120 is discharged, and capacitor C130 controls the firing of unijunction transistor UJT1 at the minimum level set by the value of potentiometer R330. Therefore, the phase control circuit including capacitor C130 allows a continuous, gradual and smooth phase and power reduction of the lamps.

When decade counter output "5" (pin 1) of decade counter IC3 is activated the periodic activation of SCR30 and SCR40 as described above begins. Furthermore, because decade counter outputs "6–8" are also connected to transistor Q40 through diode D160 and transistor Q60 through resistor R210 via their respective diodes D130–D150, the aforementioned phase control circuit operates during each on period of decade counter outputs "6–8". That is, during the activation decade counter outputs "5–8", the power applied to the lamps is continuously, gradually, and smoothly diminished until it reaches the minimum level established by potentiometer R330 as previously described. Therefore, by the end of the activation period of decade counter output "8", the power output to the lamps is at level low enough to allow autotransformer 80 to provide the power to the lamps without the lamps being extinguished.

When decade counter IC3 activates decade counter output "9" (pin 11), the sequencing of decade counter IC3 ceases and decade counter outputs "0–8" are locked in their low state as previously described in the description of decade counter IC3. With decade counter outputs "0–8" turned off, transistors Q80, Q40, and Q60 are turned off, effectively removing the solid-state phase control from the system. Removal of the phase control circuit is desirable because all of its heat-generating devices are off and will only be activated during actual operation of the phase control circuit.

Furthermore, when decade counter output "9" of IC3 is activated, current flows through resistor R130 to the base of transistor Q20, thereby turning it on. With transistor Q20 on, current flows from the emitter of Q1 through diode D50 to pin 13 of decade counter IC3 causing decade counter IC3 to "lock" with decade counter output "9" (pin 11) activated. Current from transistor Q1 also flows through resistor R140 to LED20, which is connected to ground and functions to indicate the system is operating in a reduced power mode.

Maximum Level Control Means (B)

FIG. 5B shows maximum level control 50B utilized with the continuous power reduction circuit of variable level control 70B. Maximum level control 50B in this embodiment comprises optically isolated transistor OC10, resistor R100, switch S20, diode D30, and a differentiator comprising capacitor C90 and resistor R110. In this embodiment, optically isolated transistor OC100 is a Motorola 4N35 optically isolated transistor. The emitter of transistor Q1 is connected to the LED internal to optically isolated transistor OC100, which in turn, is connected to ground through resistor R100 and switch S20. The emitter of transistor Q1 is further connected to the collector of the phototransistor internal to optically isolated transistor OC100. The emitter of the phototransistor internal to optically isolated transistor OC100 is connected to the collector of transistor Q3 and also to ground through capacitor C9 and resistor R11. Additionally, the emitter of transistor Q30 is connected to pin 13 of decade counter IC3. Resistor R180 connects transistor Q30 to ground so that decade counter IC3 will not be damaged during the resetting of the system.

When S20 is closed, current flows through the internal LED of optically isolated transistor OC100, thus activating it. With optically isolated transistor OC1 turned on, the phototransistor internal to it delivers current from the emitter of transistor Q1 to capacitor C90 and resistor R110, resulting in a pulse being applied to pin 15 of decade counter IC3 through diode D30. That pulse applied at pin 15 resets decade counter IC3. The reset of decade counter IC3 begins its operation at the first decade counter output which is decade counter output "0". The activation of decade counter output "0" applies full power to the lamps as previously described. However, if switch S20 remains closed when decade counter output "3" (pin 7) is activated by decade counter IC3, the phase control circuit will not be activated and the lamps will remain at full power. With switch S20 closed and decade counter output "3" activated, current flows through resistor R19 to the base of transistor Q30 in order to turn it on. With transistor Q30 turned on, current from the emitter of the phototransistor internal to optically isolated transistor OC100 flows through transistor Q30 and diode D60 to pin 13 of decade counter IC3. A high input received at pin 13 causes decade counter IC3 to "lock" in the particular stage of the sequence at which it is presently operating. In this instance, decade counter IC3 is frozen with decade counter output 11311 activated. A high signal from decade counter output 11311 turns on transistor Q80 which functions to deliver full power to the lamps as previously described. As long as switch S20 remains closed, transistor Q80 will remain on and full power will be delivered to the lamps. However, after switch S20 is opened, optically isolated transistor OC1 turns off, thereby stopping the current flow through transistor Q30 to pin 13 of decade counter IC3. Once pin 13 no longer receives a high input, decade counter IC3 becomes "unlocked", and the decade counter output sequence continues with the activation of decade counter output "4" . After decade counter output "5" is activated, the phase-reduction circuit will dim the lamps as described above.

In this embodiment, switch S20 may comprise a manually operated switch, an electrically operated switch connected to a time clock, a computer operated relay, or a photocell. For example, an electrically operated switch such as a solenoid activated switch could be connected to a time clock which activates and deactivates the solenoid at certain times to regulate full power operation of the lamps. That is, at a certain time in the mid-morning, the clock could turn off the solenoid which opens the switch and allows the lamps to be dimmed using variable level control 70B as described above. However, at a certain time in the evening, the clock could activate the solenoid which closes the switch and brings the lamps up to full power as described above.

Although the invention has been described in conjunction with the foregoing specific embodiments, many alternatives, variations,, and modifications should be apparent to those of ordinary skill in the art. Those alternatives, variations, and modifications are intended to fall within the spirit and scope of the appended. claims.

I claim:

1. A power saving dimming apparatus for gas discharge lamps, comprising:

first means in response to a first set of control signals for applying an entire voltage waveform of an AC supply voltage to the ballasts of a plurality of said lamps upon the initial application or the momentary interruption of power to said dimming apparatus; and second means for applying a minimum portion of each half-cycle of said AC supply voltage to said lamp ballasts, wherein said second means progressively reduces said AC supply voltage applied to said lamp ballasts from said entire voltage waveform to said minimum portion of each half-cycle in response to a second set of control signals.

2. The dimming apparatus according to claim 1 further comprising control means for generating said first and second set of control signals coupled to said first and second means.

3. The dimming apparatus according to claim 2 wherein said control means comprises a decade counter that sequentially generates a set of high output signals which serve as said first and second set of control signals.

4. The dimming apparatus according to claim 3 wherein said control means further comprises a timer for supplying a clock signal to said decade counter.

5. The dimming apparatus according to claim 1 wherein said second means progressively reduces said AC supply voltage from said entire voltage waveform to said minimum portion of each half-cycle in a step-wise reduction.

6. The dimming apparatus according to claim 1 wherein said second means progressively redudes said AC supply voltage from said entire voltage waveform to said minimum portion of each half-cycle in a continuous reduction.

7. The dimming apparatus according to claim 1 further comprising a phototransistor network for turning on said dimming apparatus in the absence of sufficient light and turning off said dimming apparatus in the presence of sufficient light.

8. The dimming apparatus according to claim 7 wherein said phototransistor network comprises a phototransistor which activates in the absence of infrared light and deactivates in the presence of infrared light.

9. The dimming apparatus according to claim 2 further comprising means for locking said control means with said first set of control signals actuated to continuously maintain said first means activated so that said entire voltage waveform of said AC supply voltage is applied to said lamps ballasts.

10. The dimming apparatus according to claim 2 further comprising power supply means for supplying power to said dimming apparatus.

11. The dimming apparatus according to claim 1, wherein said first means comprises an optically isolated triac driver coupled to a pair of SCRs connecting said lamp ballasts to said AC supply voltage, wherein said optically isolated triac driver actuates said SCRs in response to said first set of control signals to deliver said entire voltage waveform of said AC supply voltage to said lamp ballasts.

12. The dimming apparatus according to claim 11, wherein said second means, comprises:

a triac coupled to the gate of each of said SCRs;

a diac coupled to the gate of said triac; and a timing capacitor coupled to said diac and said AC supply voltage through a resistor network, wherein said timing capacitor activates said diac when it charges to the breakover voltage of said diac, and further wherein sequential stages of said resistor network are coupled to said timing capacitor in response to said second set of control signals in order to step-wise increase the charging time of said timing capacitor.

13. The dimming apparatus according to claim 12, wherein said resistor network includes a potentiometer which permits manual adjustment of the charging time of said timing capacitor.

14. The dimming apparatus according to claim 11, wherein said second means, comprises:

a triac coupled to the gate of each of said SCRs;

a unijunction transistor coupled to the gate of said triac, a first capacitor coupled to the emitter of said unijunction transistor and to the output of a bridge rectifier, wherein said first capacitor activates said unijunction transistor when it charges to the firing voltage of said unijunction transistor; and a second capacitor coupled to said first capacitor, wherein said second capacitor discharges into said first capacitor in response to said second set of control signals in order to initially decrease the charging time of said first capacitor, and further wherein as said second capacitor discharges, the charging time of said first capacitor continuously increases to a maximum level.

15. The dimming apparatus according to claim 14, wherein said second means further comprises a potentiometer coupled to said first capacitor which permits the manual adjustment of the charging time of said first capacitor.

16. The dimming apparatus according to claim 1 wherein in response to the deactivation of said second set of control signals, said second means transfers control of the application of said AC supply voltage to said lamp ballasts to an auxiliary power reducing transformer to maintain a high power factor and reduced harmonics.

* * * * *